United States Patent [19]

Watanabe

[11] 4,455,774

[45] Jun. 26, 1984

[54] COMPOSITE FLUORESCENT DISPLAY APPARATUS

[75] Inventor: Hiroshi Watanabe, Mobara, Japan

[73] Assignee: Futaba Denshi Kogyo Kabushiki Kaisha, Mobara, Japan

[21] Appl. No.: 283,120

[22] Filed: Jul. 14, 1981

[30] Foreign Application Priority Data

Jul. 15, 1980 [JP] Japan ..... 55-95652

[51] Int. Cl.[3] ..... H01J 63/02

[52] U.S. Cl. ..... 40/451; 313/496; 313/513; 313/519

[58] Field of Search ..... 40/451, 452, 541, 542, 40/543, 544, 570, 578, 579, 580; 313/188, 496, 513, 519, 497, 1; 340/718, 753, 774

[56] References Cited

U.S. PATENT DOCUMENTS

| | | | |
|---|---|---|---|
| 3,182,415 | 5/1965 | Brooks | 40/544 |
| 3,246,204 | 4/1966 | Katona | 40/544 |
| 3,668,688 | 6/1972 | Schmersal | 340/718 |
| 3,776,613 | 12/1973 | Van Esdonk et al. | 313/188 |
| 3,800,186 | 3/1974 | Yamane et al. | 340/773 |
| 3,906,285 | 9/1975 | Kobayakawa et al. | 313/496 |
| 3,942,161 | 3/1976 | Byrum, Jr. et al. | 340/774 |
| 4,001,629 | 1/1977 | Thayer | 313/517 |
| 4,004,186 | 1/1977 | Bylander | 313/513 |
| 4,020,386 | 4/1977 | Yasutome et al. | 313/513 |
| 4,045,703 | 8/1977 | Mori et al. | 313/513 |
| 4,090,102 | 5/1978 | Yasutome et al. | 313/519 |
| 4,162,422 | 7/1979 | Morimoto et al. | 313/513 |
| 4,164,683 | 8/1979 | Nakamura et al. | 313/496 |
| 4,178,593 | 12/1979 | Kishino et al. | 340/753 |

*Primary Examiner*—Gene Mancene
*Assistant Examiner*—David L. Tarnoff
*Attorney, Agent, or Firm*—Oblon, Fisher, Spivak, McClelland & Maier

[57] ABSTRACT

A composite fluorescent display apparatus which permits the luminous display to be observed through a transparent substrate on which various functional elements of the fluorescent display apparatus are formed. The composite fluorescent display apparatus includes pattern display portions which are divided into several groups each effecting different types of display, and each of the pattern display portions is contained in a separate vacuum casing hermetically sealed by a back cover.

4 Claims, 7 Drawing Figures

COMPOSITE FLUORESCENT DISPLAY APPARATUS

BACKGROUND OF THE INVENTION

1. Field of the Invention

This invention relates to a fluorescent display apparatus, and more particularly to a composite fluorescent display apparatus of the type which permits the luminous display to be observed through a transparent substrate on which various functional elements of the fluorescent display apparatus are formed.

2. Description of the Prior Arts

A fluorescent display apparatus effects luminous display in the form of letters, figures and the like by selectively impinging electrons emitted from heated cathodes upon anodes having phosphor layers deposited thereon. The fluorescent display apparatus is widely used as a display device in various electronic appliances and instruments, because it can be driven at a relatively low voltage and is low in power consumption and emits luminous color which is easy to observe.

The fluorescent display apparatus generally may be classified in two categories. One involves observing the luminous display of phosphor layers deposited on the upper surface of anodes formed on an insulating substrate through a grid, cathode and front cover, and the other is to observe the luminous display of phosphor layers through a transparent substrate on which there are formed various functional elements of the fluorescent display apparatus, such as, for example, anodes made of transparent conductive films having the phosphor layers deposited thereon, grids and cathodes, all of which are contained in a vacuum envelope covered with a back cover.

In the fluorescent display apparata explained above, the vacuum envelope which is made of the substrate and the front or back cover must be constructed so as to be strong enough to withstand pressure in the case where a large-sized composite fluorescent display apparatus which includes various kinds of display patterns for effecting different types of display in one fluorescent display apparatus is fabricated. In the conventional composite fluorescent display apparatus, such a vacuum envelope is produced by using the substrate and the front or back cover which are made of a thick glass plate or interposing reinforcing members between the substrate and the cover within the envelope. The vacuum envelope produced by these techniques is not totally satisfactory in that the use of the thick substrate and cover increases the overall weight of the fluorescent display apparatus. In addition, complicated processes are required in the production of the cover, which results in an increase in the production costs. Also, problems arise with this vacuum envelope in forming and mounting each of electrodes in the fluorescent display apparatus. On the other hand, the vacuum envelope provided with the reinforcing member is difficult to produce and is not satisfactory from a standpoint of production efficiency. Furthermore, problems arise with the fluorescent display apparatus using the vacuum envelope of this type due to remarkably restriction of the viewing angle of the display in the case where the display is observed from the side of the front cover. In a possible alternating arrangement, there is proposed such a composite fluorescent display apparatus that is composed by assembling a plurality of small-sized fluorescent display tubes on a panel so that the display surfaces of each of the display tubes may be laid on the same plane. However, this composite fluorescent display apparatus is not satisfactory, because it is bulky and less appealing in its appearance, and wirings in each of the display tubes become too congested.

BRIEF SUMMARY OF THE INVENTION

Therefore, the present invention is intended to eliminate the above-mentioned disadvantages of the prior art.

It is an object of the present invention to provide a composite fluorescent display apparatus which is light in weight, excellent in appearance, and capable of effecting different types of display in one display apparatus.

It is another object of the present invention to provide a composite fluorescent display apparatus which permits ratio of space occupied by display patterns to overall dimensions of a substrate to be improved remarkably.

It is further object of the present invention to provide a composite fluorescent display apparatus which is capable of effecting display which is easy to observe from a wide viewing angle without accompanying any viewing distortion of the indicator elements.

It is still another object of the present invention to provide a composite fluorescent display apparatus which is easy to manufacture, reliable in its operation, and simplifies various processes required for forming the display apparatus in a great deal, thereby to improve the production efficiency and to reduce the manufacturing costs of the apparatus.

The foregoing and other objects are attained in accordance with an aspect of the present invention through the provision of a composite fluorescent display apparatus of the type which permits the display to be observed through a transparent substrate made of an insulating material on which pattern display portions for effecting different types of display are arranged. The pattern display portions are divided into several groups, each of which is hermetically sealed by an independent back cover.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENT

A composite fluorescent display apparatus according to the present invention will be hereinafter described with reference to the accompanying drawings.

Figure 1:
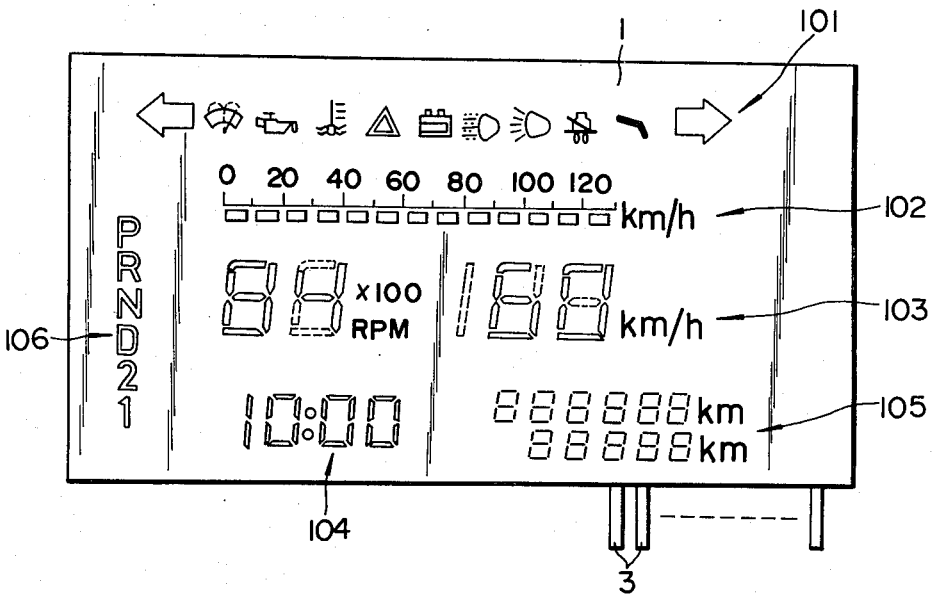
FIG. 1 is a plan view of a composite fluorescent display apparatus looking in the direction of observing the display according to an embodiment of the present invention.
Figure 2:
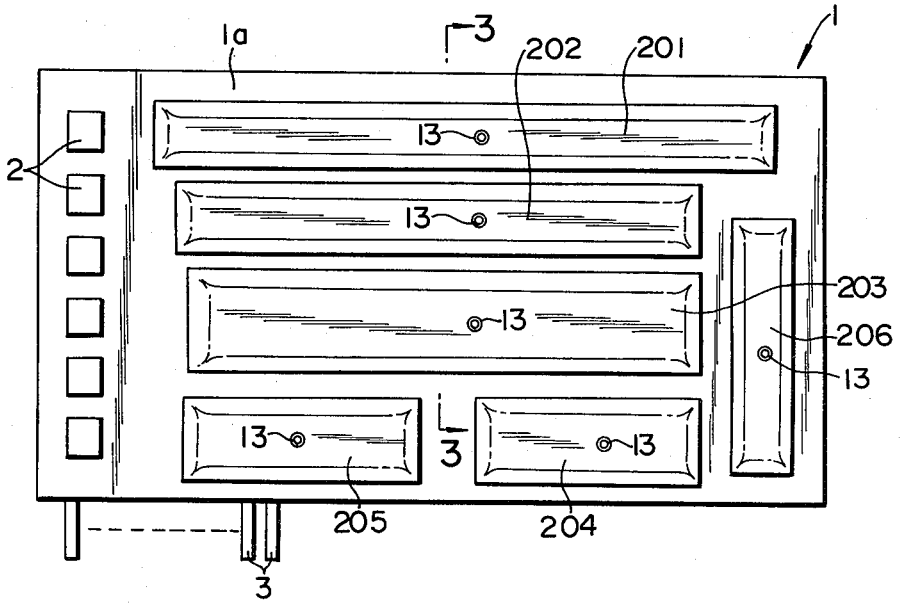
FIG. 2 is a rear view of the composite flourescent display apparatus shown in FIG. 1.
Figure 3:
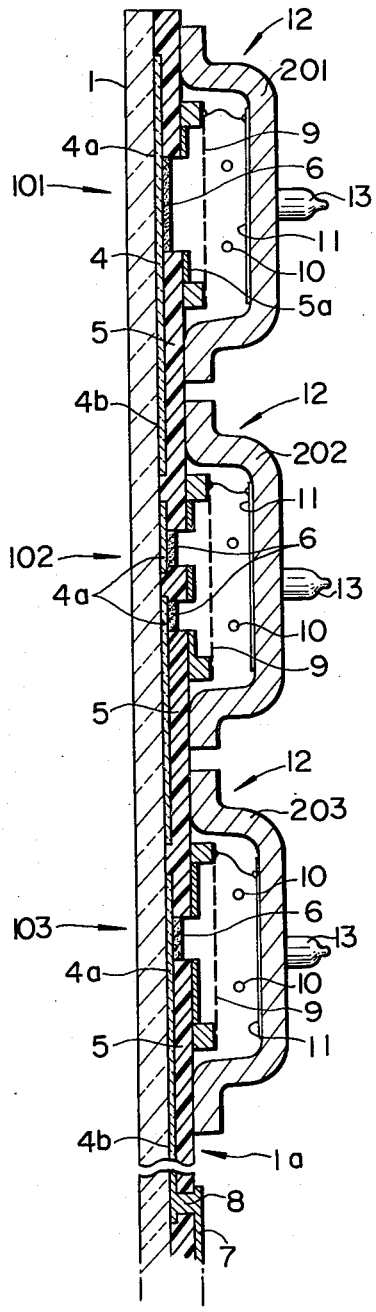
FIG. 3 is an enlarged vertical cross sectional view of the essential part of the composite fluorescent display apparatus taken along the line 3—3 of FIG. 2.

FIGS. 1 to 3 illustrate a composite fluorescent display apparatus according to a first embodiment of the present invention which is applied to a display panel with instruments or gauges on it, as in an automobile. The composite fluorescent display apparatus comprises a transparent substrate 1 made of an insulating material such, for example, as glass, on the rear surface of which various pattern display portions for effecting different types of display are arranged. In the apparatus shown in FIG. 1, there are formed the pattern display portion 101 including an "OK" monitor and winkers, the pattern display portion 102 indicating analog display of speed, the pattern display portion 103 indicating digital displays of speed and revolution of an engine, the pattern display portion 104 for clock, the pattern display portions 105 indicating a trip and integrating trip kilometers, and the pattern display portion 106 indicating a position of change gear.

Figure 4:
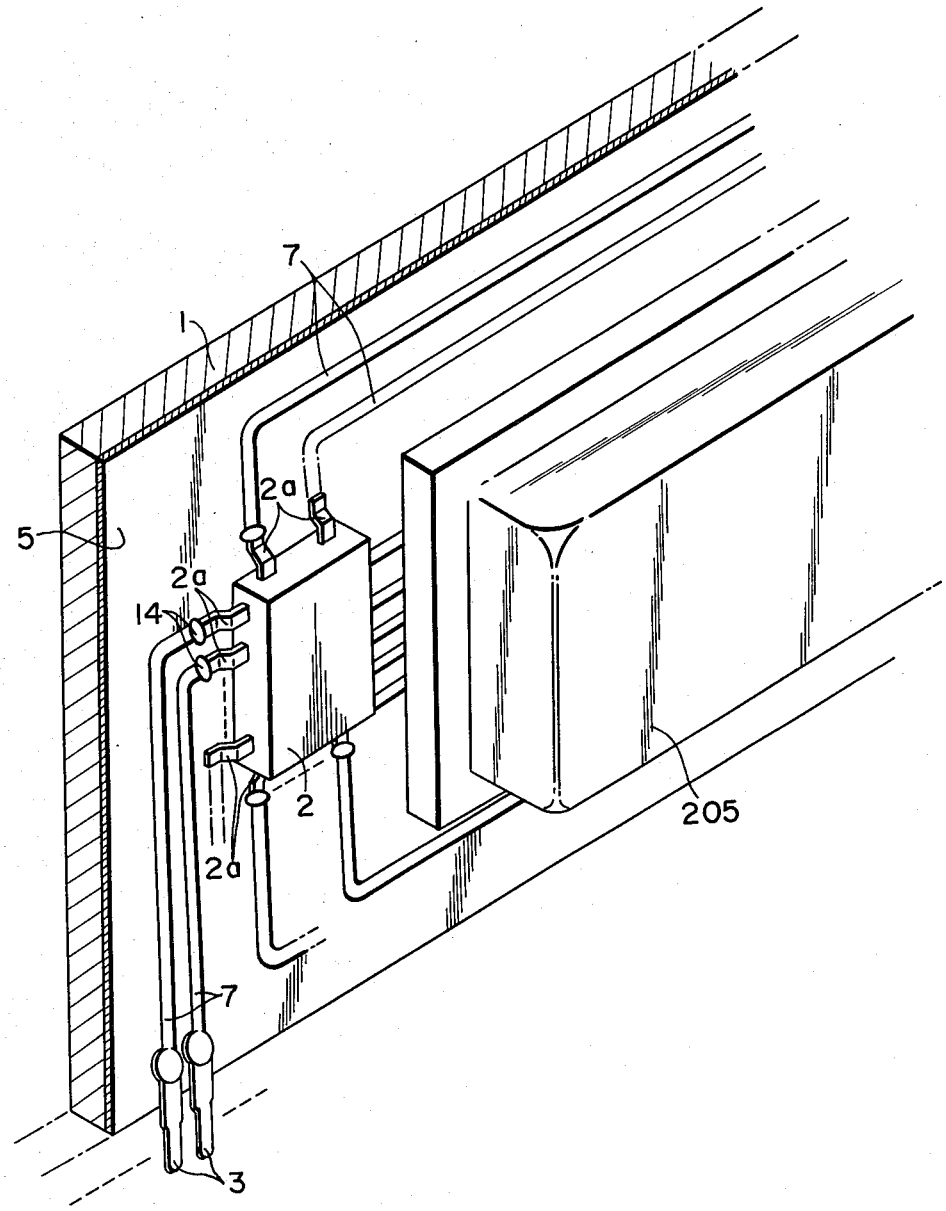
FIG. 4 is an enlarged perspective view of driving circuits for the composite fluorescent display apparatus of the present invention.

As shown in FIG. 2, each of these pattern display portions 101, 102, 103, 104, 105 and 106 is hermetically sealed by back covers which are bonded to the rear surface 1*a* of the substrate 1*a*, thereby forming envelopes each containing one of these pattern display portions. Namely, the pattern display portion 101 including the "OK" monitor and winkers is covered with the back cover 201, the pattern display portion 102 indicating analog display of speed is covered with the back cover 202, the pattern display portion 103 indicating digital displays of speed and revolution of an engine is covered with the back cover 203, the pattern display portion 104 for clock is covered with the back cover 204, the pattern display portions 105 indicating a trip and integrating trip kilometers is covered with the back cover 205, and the pattern display portion 106 indicating the position of change gear is covered with the back cover 206. In addition, the are formed integrated driving circuits 2 which includes deorder and driving circuits on the rear surface 1*a* of the substrate 1 as shown in FIGS. 2 and 4. Furthermore, wiring conductors 7 for connecting each of the pattern display portions 101, 102, 103, 104, 105 and 106 to the driving circuits 2 and for connecting the driving circuits 2 to external lead terminals 3 which extend from the outer peripheral corner of the substrate 1 are formed on the rear surface 1*a* of the substrate 1.

The internal structure of the composite fluorescent display apparatus of the present invention will now be explained hereinafter with reference to the cross sectional view of the apparatus shown in FIG. 3. The composite fluorescent display apparatus includes transparent conductive film 4 serving as anode conductors as well as lead wires which are divided into several fractions corresonding to the shape of display pattern and the number of anode in each of the pattern display portions and deposited on the rear surface 1*a* of the substrate 1. The transparent conductive films 4 are covered with semitransparent or opaque insulating layers 5 remaining transparent electrodes 4*a* corresponding to the shape of anodes, and thin phosphor layers 6 are deposited on the transparent electrodes 4. The transparent conductive films 4 covered with the insulating layers 5 serve as the lead wires 4*b* to be connected to the transparent conductive film 4 of adjacent display patterns or wirings 7 formed on an external surface of the apparatus through throughholes 8. In order to prevent electrification, conductive films 5*a* may be deposited on the insulating layers 5, if required. Reference numeral 9 designates grids which are mounted opposite to the respective phosphor layers 6. In addition, there are provided filamentous cathodes 10 above the grids which emit thermions when energized and heated.

As explained above, the back covers 201, 202, 203, 204, 205 and 206 are fixed to the rear surface 1*a* of the substrate 1 in such a manner that the phosphor layers 6, the grids 9 and the cathodes 10 in each of the pattern display portions 101, 102, 103, 104, 105 and 106 may be enclosed within an envelope 12. The back cover may be a box shape or flat bottom boat shape configuration as shown in FIG. 3, and the inside surface of the back cover is coated with conductive films 11 for preventing electrification and intercepting an external electric field. The conductive films 11 may be electrically connected to the cathodes 10 or the grids 9. Alternatively, the conductive films 11 may be connected to the wirings 7 and suitable potential between cathode and anode potentials may be applied to the conductive film 11 by means of the wirings 7. In this manner, there are provided the airtightly sealed envelopes 12 formed of the back covers 201, 202, 203, 204, 205 and 206 and the substrate 1. As shown in FIGS. 2 and 3, each of the back covers is provided with an exhaust tube for evacuatating the envelope 12, which is sealed after the evacuatation of the envelope 12.

The grids 9, the cathodes 10 and the transparent electrodes 4*a* are connected to the driving circuits 2 by means of the wirings 7. As shown in FIG. 4, the driving circuit 2 is of a flat package type structure which permits each of its terminals 2*a* to be directly connected to the respective wirings 7 by means of a conductive adhesive agent 14 such, for example, as solder. In the same manner, input terminals of the driving circuits 2 are connected to the external lead terminals 3 by means of the wirings. It is a matter of course that the driving circuit 2 and the wirings 7 may be connected by wire bonding techniques or face down bonding techniques. In the composite fluorescent display apparatus explained above, if the conductive film 11 is formed of a light absorbing black conductive material such, for example, as graphite, the conductive film 11 absorbs light emitted from the phosphor layers 6 in the direction of the back covers 201, 202, 203, 204, 205, and 206, which makes it possible to eliminate such disadvantages that deenergizing anodes are illuminated by light reflected upon the conductive film 11, thereby to decrease luminous contrast between the energizing and deenergizing anodes.

The composite fluorescent display apparatus of the present invention is produced by the method which will be explained hereinafter.

First, there are formed the transparent conductive films 4 which are divided into several fractions corresponding to the shape of anode and its wiring pattern on the rear surface 1*a* of the substrate 1. The transparent conductive films 4 are prepared by applying the films on the overall surface of the substrate 1 and subsequently removing unnecessary portions of the film by photolithography. Alternatively, the transparent conductive films 4 having the predetermined patterns may be directly formed on the substrate 1 by a vacuum evaporation using a mask.

Then, the insulating layers 5 are deposited on the transparent conductive films 4 remaining the transparent electrodes 4*a* in the shape of anode and connecting portions of the grids 9 and the cathode 10. The insulating layers 5 may be formed by depositing a material which consists of frit glass having a low melting point on the films 4 utilizing a screen printing process and baking the material. A suitable pigment is preferably mixed in the material to render the resulting insulating layers 5 optically semitransparent or opaque. As far as the insulating layers 5 is semitransparent or opaque, the color of the insulating layer 5 is not essential. However, it is preferable to have the insulating layers 5 painted in color which is similar to natural color of the phosphor layers 6 at the time of deenergizing the phosphor to be deposited in the subsequent step.

The phosphor layers 6 are deposited on the transparent electrodes 4*a* formed on the substrate 1 which are not covered with the insulating layers and serve as the anodes. In the deposition of the phosphor layers 6, any suitable method, such as, for example, precipitation techniques, screen printing techniques, electrodeposition techniques or slurry techniques may be used. The thickness of the phosphor layers 6 deposited on the transparent electrodes 4*a* is preferably as thin as possible, because light emitted from the phosphor layers 6 comes out of the envelope 12 through the phosphor layers 6.

The wirings 7 are formed by depositing a conductive material on the external surface of the insulating layers 5 utilizing screen printing techniques. Then, the grids 9, cathodes 10 are mounted in accordance with the conventional manner, and the back covers 201, 202, 203, 204, 205 and 206 are fixed to the substrate 1 to provide the envelopes in which each of the pattern display portions is enclosed. The inside of the envelopes is evacuated in a high vacuum state by using the exhaust tubes 13, and the exhaust tubes are airtightly sealed after the evacuation. Then, the respective wirings 7 are connected to the driving circuits 2.

In this manner, the composite fluorescent display device of the present invention is assembled. When this composite fluorescent display device is connected to an external power source, electrons emitted from the cathode 10 impringe upon the phosphor layers 6 to excite them for emitting light. The light emitted from the phosphor layers 6 passes through the phosphor layers 6, the transparent electrodes 4*a* and the substrate 1 and is observed from the front surface of the substrate 1. The light emitted in the direction of the grids 9 from the phosphor layers 6 within the envelopes 12 is absorbed in the conductive film 11 and the insulating layers 5, and there is no possibility of the light coming through deenergized anodes.

Although the composite fluorescent display apparatus according to the present invention is large enough to include a plurality of the pattern display portions 101, 102, 103, 104, 105, and 106, it is to be understood that each of the pattern display portions is sectionalized and is sealed by the separate back covers 201, 202, 203, 204, 205, and 206. Thus, each of the vacuum envelopes 12 is of almost the same volume as that of the small-sized fluorescent display tube. In the composite fluorescent display apparatus of the present invention, it is not necessary to make the vacuum envelope strong by using plate glass or reinforcing members so as to withstand pressure, as in the conventional large-sized fluorescent display apparatus. According to the present invention, the large-sized fluorescent display apparatus can be produced by the conventional techniques used in manufacturing the small-sized fluorescent display tube. In the present invention, the functional elements of the fluorescent display apparatus such, for example, as the grids and the cathode, can be mounted to the apparatus in the same manner as in the conventional small-sized fluorescent display tube.

In the fluorescent display apparatus according to the embodiment explained above, each of the back covers is provided with the exhaust pipes 13 for evacuating the respective envelopes. However, the exhaust pipes 13 may be arranged as shown in FIG. 6 which illustrates a second embodiment of the present invention so that efficiency of the evacuating operation may be increased.

Figure 5:
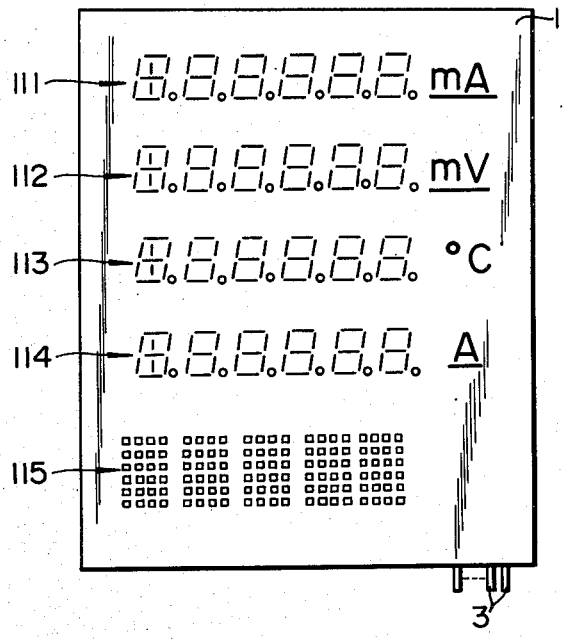
FIG. 5 is a plan view of a composite fluorescent display apparatus looking in the direction of observing the display according to another embodiment of the present invention.
Figure 6:
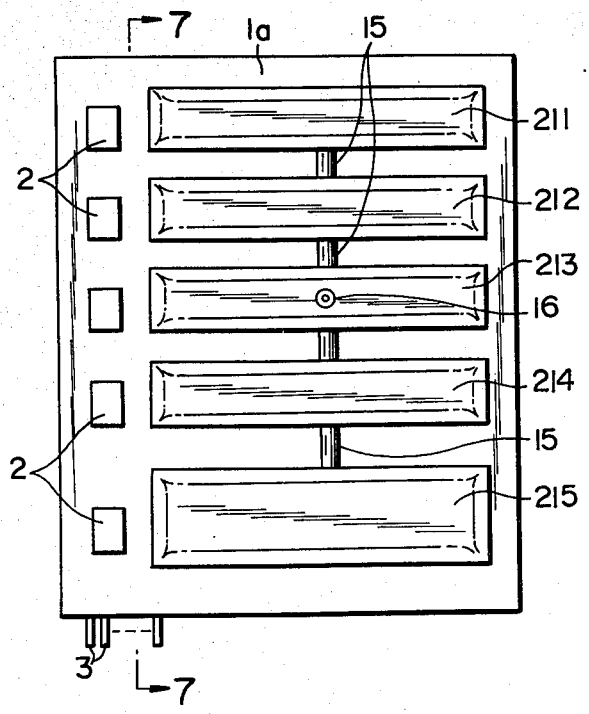
FIG. 6 is a rear view of the composite fluorescent display apparatus shown in FIG. 5.
Figure 7:
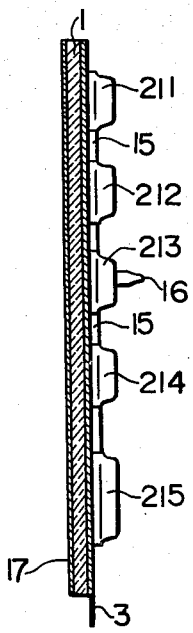
FIG. 7 is a vertical sectional view of the composite fluorescent display apparatus taken along the line 7—7 of FIG. 6.

Referring now to the second embodiment of the fluorescent display apparatus according to the present invention with reference to FIGS. 5, 6, and 7, the fluorescent display apparatus of this embodiment comprises a transparent substrate 1 made of an insulating material on which display patterns in the form of an industrial measuring panel are formed. As shown in FIG. 5, the display patterns include a pattern display portion 111 indicating dc milliampare, a pattern display portion 112 indicating dc millivolt, a pattern display portion 113 indicating temperature, a pattern display portion 114 indicating ac ampare, and a pattern display portion 115 indicating messages in the form of dot-matrix. As shown in FIGS. 6 and 7, each of these pattern display portions 111, 112, 113, 114, and 115 is hermetically sealed by back covers 211, 212, 213, 214 and 215 which are bonded to the rear surface 1*a* of substrate 1.

As shown in FIG. 6, each of the back covers 211, 212, 213, 214, and 215 are connected by an exhaust pipe 15 which permits the inside of the respective back covers 211, 212, 213, 214, and 215 to communicate with one another, and an exhaust pipe 16 is formed on any one of the back covers 211, 212, 213, 214, and 215, for example, the back cover 213, extending outwardly from the rear surface thereof. The exhaust pipe 16 is airtightly sealed after evacuating envelopes. Reference numeral 17 designates a shade mask or color filter to be fixed to the front surface of the substrate 1, if required. The internal structure of the fluorescent display apparatus according to the second embodiment of the present invention is identical with that of the fluorescent display apparatus of the first embodiment. Therefore, detailed explanation of the internal structure is omitted, and the same or corresponding parts of the apparata are shown by using the same reference numerals.

Obviously, many modification and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A composite fluorescent display apparatus comprising:

a transparent substrate made of an insulating material;

a plurality of anodes made of a transparent conductive film, each anode coated with a phosphor layer on an upper surface thereof and disposed on said substrate in the shape of a display pattern;

said anodes being divided into at least two groups each having different display patterns for effecting different types of display;

filamentous cathodes stretched above each of said anodes for emitting thermions when energized and heated;

said thermions emitted from said cathodes being adapted to impinge upon said anodes so as to make said phosphor layer emit light; and at least two back covers each of said at least two back covers air tightly bonded to said substrate so as to separately enclose a respective one of said anode groups and at least one of said cathodes within a respective one of at least two vacuum envelopes each made up of a portion of said substrate and one of said at least two back covers.

2. The composite fluorescent display apparatus as defined in claim 1, wherein said anodes and said cathodes are electrically extended to the outside of said envelopes through wirings disposed on said substrate.

3. The composite fluorescent display apparatus as defined in claim 2, further comprising driving circuits mounted on said substrate, said driving circuits being directly connected to said wirings.

4. The composite fluorescent display apparatus as defined in claim 1, 2, or 3, wherein said vacuum envelopes are communicated by means of exhaust pipes.

* * * * *